US007628656B2

(12) United States Patent
Shields et al.

(10) Patent No.: US 7,628,656 B2
(45) Date of Patent: Dec. 8, 2009

(54) RECEPTACLE WITH CROSSTALK OPTIMIZING CONTACT ARRAY

(75) Inventors: Linda Ellen Shields, Camp Hill, PA (US); Paul John Pepe, Clemmons, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/372,957

(22) Filed: Mar. 10, 2006

(65) Prior Publication Data

US 2007/0212946 A1 Sep. 13, 2007

(51) Int. Cl.
*H01R 24/00* (2006.01)

(52) U.S. Cl. ..... 439/676; 439/941

(58) Field of Classification Search ..... 439/676, 439/941, 620.17, 620.18
See application file for complete search history.

(56) References Cited

U.S. PATENT DOCUMENTS 5,626,497 A 5/1997 Bouchan et al.
5,941,734 A * 8/1999 Ikeda et al. ..... 439/676
6,139,368 A * 10/2000 Bogese, II ..... 439/620.17
6,190,211 B1 2/2001 Chu
6,196,880 B1 3/2001 Goodrich et al.
6,464,541 B1 10/2002 Hashim et al.
6,530,810 B2 * 3/2003 Goodrich et al. ..... 439/676
6,558,207 B1 * 5/2003 Pepe et al. ..... 439/862
6,592,395 B2 * 7/2003 Brown et al. ..... 439/405
6,896,557 B2 * 5/2005 Aekins et al. ..... 439/676
6,916,209 B1 * 7/2005 Casher et al. ..... 439/676
7,052,328 B2 * 5/2006 Ciezak et al. ..... 439/676
7,264,516 B2 * 9/2007 Hashim et al. ..... 439/676
2003/0003810 A1 * 1/2003 Jaouen ..... 439/676

* cited by examiner

*Primary Examiner*—Tho D Ta
*Assistant Examiner*—Travis Chambers

(57) ABSTRACT

A receptacle assembly comprises a housing having front and rear ends. The front end receives a plug and the rear end accepts wire termination contacts. A circuit board has a plurality of contact holes and is held within the housing. A plurality of array contacts is arranged in a contact array within the housing. Each of the plurality of array contacts comprises a main section and a contact tail. The main section runs generally perpendicular to the circuit board. The contact tail has a first bend forming a first tail sub-section extending parallel to the circuit board and a second bend forming a second tail sub-section extending perpendicular to the circuit board. The second tail sub-section of each of the plurality of array contacts is received by one of the plurality of contact holes in the circuit board.

22 Claims, 5 Drawing Sheets

RECEPTACLE WITH CROSSTALK OPTIMIZING CONTACT ARRAY

BACKGROUND OF THE INVENTION

This invention relates generally to electrical connectors, and more particularly, to a modular jack or receptacle with an array layout for reducing crosstalk.

Various electronic systems, such as those used to transmit signals in the telecommunications industry, include connector assemblies with electrical wires arranged in differential pairs. One wire in the differential pair carries a positive signal and the other wire carries a negative signal intended to have the same absolute magnitude, but at an opposite polarity.

An RJ-45 electrical connector, having a plug and outlet jack, is one example of a connector used to transmit electrical signals in differential pairs. An RJ-45 plug has four differential pairs of wires. The plug has a high level of noise due to the arrangement of the wires as determined by industry standards.

Multiple differential pairs are positioned in close proximity to each other in the connector and generate unwanted electromagnetic (EM) signal coupling or crosstalk, which degrades the quality of the signal transmissions. Another problem experienced is mismatched impedance as a signal is transmitted through the plug and the receptacle assembly. The mismatched impedance causes a portion of the electrical signal to be reflected back toward its source. The amount of reflection that occurs due to impedance mismatch may be quantified as return loss.

In addition, connector assemblies are being used to transmit data across higher frequencies and wider bandwidths. As frequencies increase, the system experiences more signal degradation due to EM signal coupling, return loss and impedance mismatch.

Therefore, a need exists for an electrical connector design optimized to negate crosstalk and reduce return loss to improve electrical performance. Certain embodiments of the present invention are intended to meet these needs and other objectives that will become apparent from the description and drawings set forth below.

BRIEF DESCRIPTION OF THE INVENTION

In one embodiment, a receptacle assembly comprises a housing having front and rear ends. The front end is configured to receive a plug and the rear end is configured to accept wire termination contacts. A circuit board has a plurality of contact holes and is held within the housing. A plurality of array contacts is arranged in a contact array within the housing. Each of the plurality of array contacts comprises a main section and a contact tail. The main section runs generally perpendicular to the circuit board. The contact tail has a first bend to form a first tail sub-section extending parallel to the circuit board and a second bend to form a second tail sub-section extending perpendicular to the circuit board. The second tail sub-section of each of the plurality of array contacts is received by one of the plurality of contact holes in the circuit board.

In another embodiment, a receptacle assembly comprises a housing having front and rear ends. The front end is configured to receive a plug and the rear end is configured to accept wire termination contacts. A circuit board is held within the housing and has first and second sides located opposite one another and top and bottom ends located opposite one another. The circuit board comprises a plurality of contact holes arranged in a contact array pattern and a plurality of wire termination contact holes arranged in a wire termination contact pattern. A plurality of array contacts is arranged in a contact array within the housing. The contact array comprises at least second and third differential pairs. The plurality of wire termination contact holes configured to receive the wire termination contacts associated with the second differential pair are located proximate the top end and the second side of the circuit board and the plurality of wire termination contact holes configured to receive the wire termination contacts associated with the third differential signal pair are located proximate the bottom end and the first side of the circuit board.

The foregoing summary, as well as the following detailed description of certain embodiments of the present invention, will be better understood when read in conjunction with the appended drawings. It should be understood that the present invention is not limited to the arrangements and instrumentality shown in the attached drawings.

DETAILED DESCRIPTION OF THE INVENTION

Figure 1:
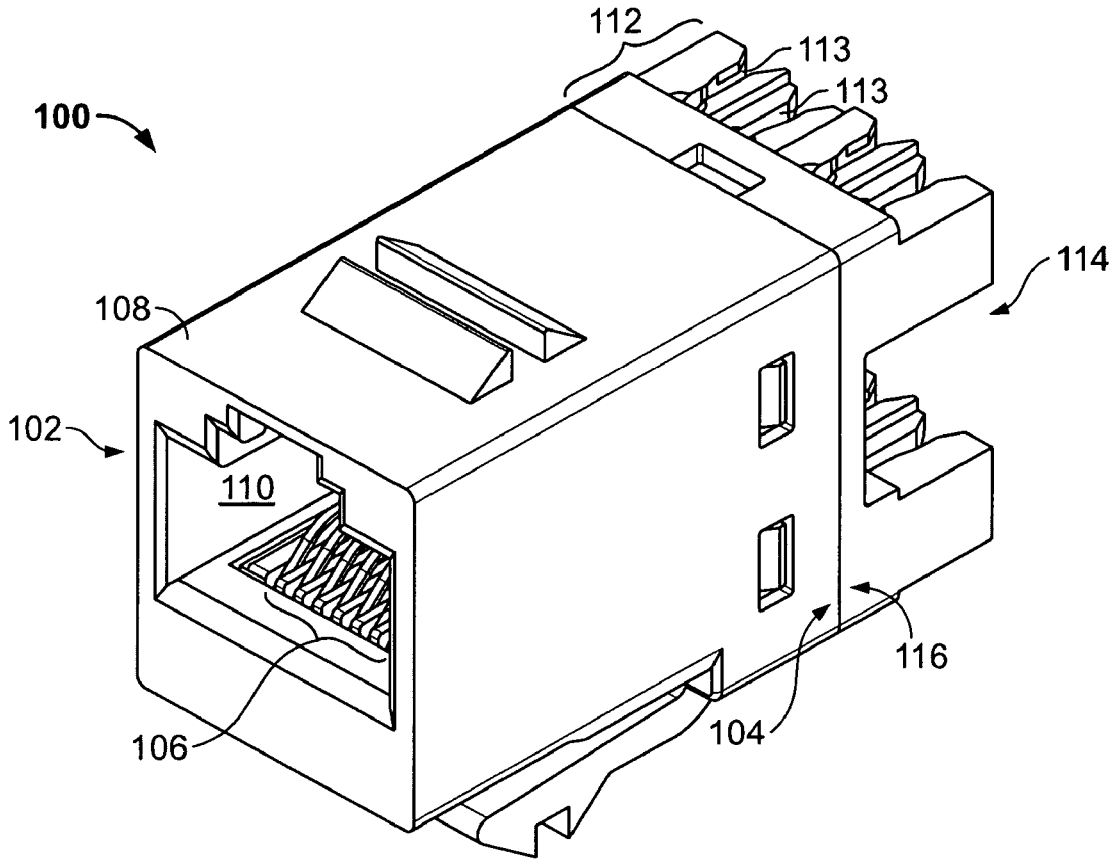
FIG. 1 illustrates a perspective view of an outlet type receptacle assembly in accordance with an embodiment of the present invention.

FIG. 1 illustrates a receptacle assembly 100. The receptacle assembly 100 has a front end 102 and a rear end 114. A housing 108 partially encloses a contact array 106 within a cavity 110. In the example of FIG. 1, the cavity 110 accepts an RJ-45 plug (not shown) inserted through the front end 102. The RJ-45 plug has contacts which electrically interface with the contact array 106. A circuit board 148 (FIG. 2) is mounted within the housing 108 proximate a housing rear end 104. A front end 116 of a wire connector housing 112 mates to the housing rear end 104. The wire connector housing 112 accepts wires from a cable (not shown) through rear end 114 which electrically interface with wire termination contacts 113 held within the wire connector housing 112.

Figure 2:
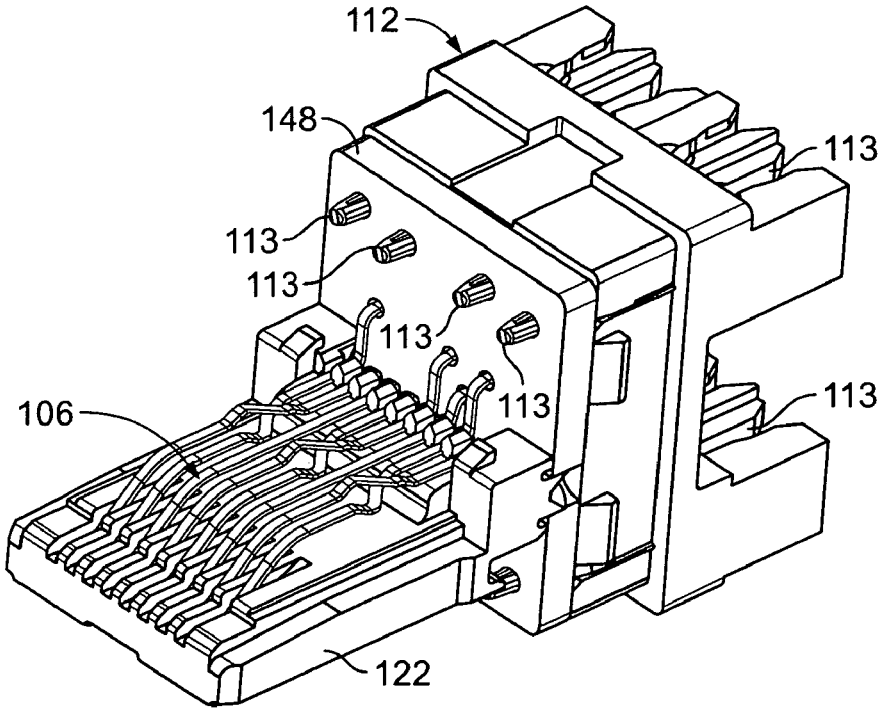
FIG. 2 illustrates the receptacle assembly of FIG. 1 with the housing removed in accordance with an embodiment of the present invention.

FIG. 2 illustrates the receptacle assembly 100 of FIG. 1 with the housing 108 removed. The wire termination contacts 113 are accepted by wire termination contact holes (illustrated in FIGS. 3 and 4) in the circuit board 148 and establish contact with conductive material on the circuit board 148.

In this example, the wire termination contacts 113 are insulation displacement contacts (IDCs), however, other connection means may be used. The wires within the cable terminate at an IDC end of the IDC contacts. The opposite end of the IDC contacts interface with the circuit board 148 within the wire termination contact holes. The wire termination contacts 113 terminate at the circuit board 148 with eye of the needle contacts, compliant pins, solder, press-in connection or other means known to those skilled in the art.

Figure 3:
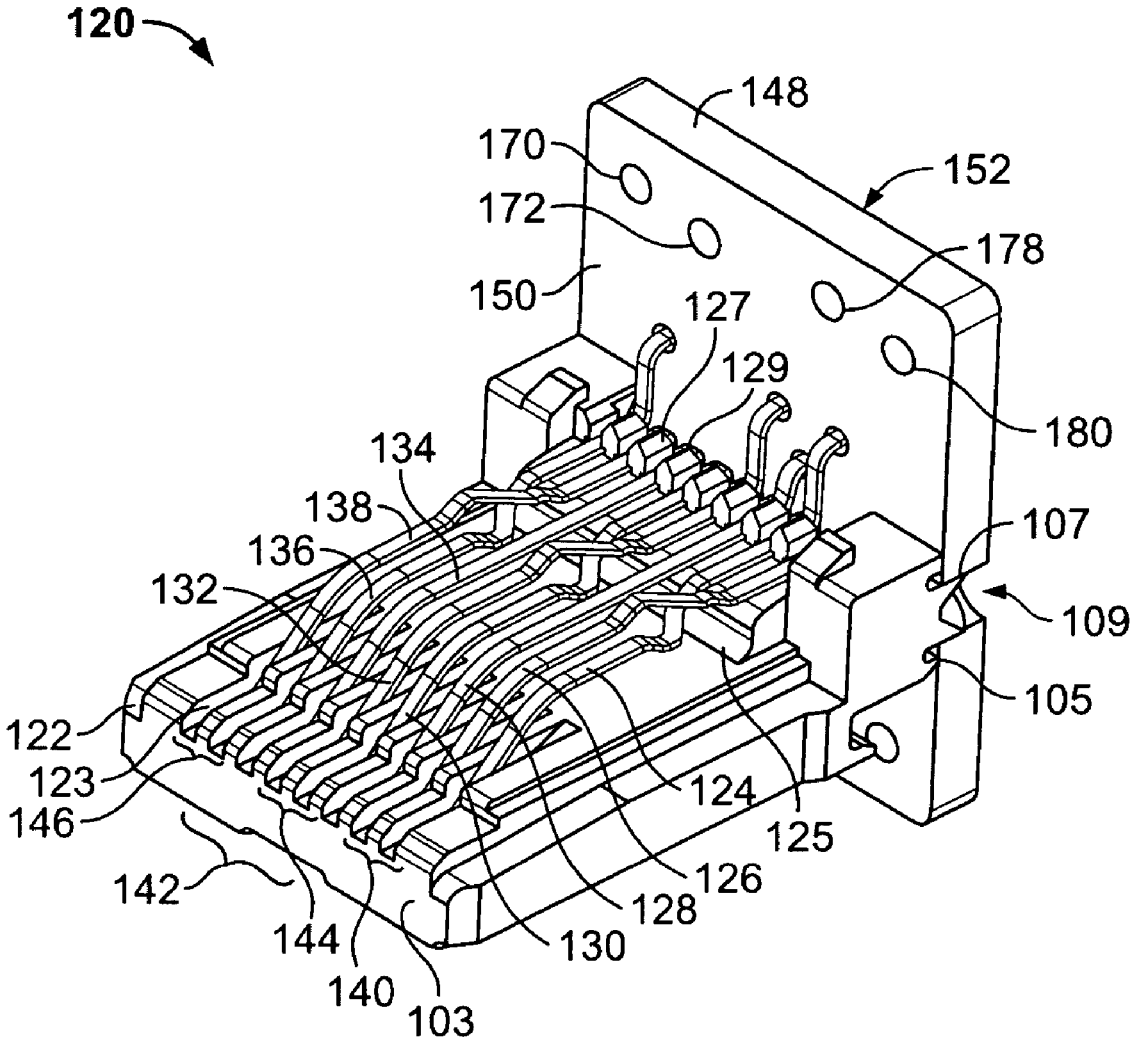
FIG. 3 illustrates a front perspective view of a sub-assembly within the receptacle assembly of FIG. 1 in accordance with an embodiment of the present invention.

FIG. 3 illustrates a front perspective view of a sub-assembly 120 within the receptacle assembly 100 of FIG. 1. The sub-assembly 120 includes a base 122 which may be formed of plastic or other nonconductive material. The base 122 has a lead edge 103 facing and located proximate to the front end 102 (FIG. 1) of the housing 108 and a rear edge 105 facing and located proximate to the housing rear end 104. Optionally, the base 122 may have a PCB surface on which the contact array 106 may lay. Alternatively, a circuit board (not shown) may be used instead of the base 122 to provide signal conditioning.

The rear edge 105 includes posts 107 that are configured to be received in holes 109 in the front face 150 of the circuit board 148. The posts 107 may perform alignment and/or locking functions, in order to position and hold the rear edge 105 against the front face 150 of the circuit board 148 in a desired alignment and orientation. The base 122 includes a series of parallel notches 123 formed therein which extend to the lead edge 103 and are spaced apart from one another in a desired manner. The base 122 also includes a bridge 125 located proximate the rear edge 105. The bridge 125 has a series of posts 127 extending upward therefrom and spaced apart from one another by gaps 129 aligned with the notches 123. The array contacts in the contact array 106 have an interference fit with the posts 127 and gaps 129.

Figure 4:
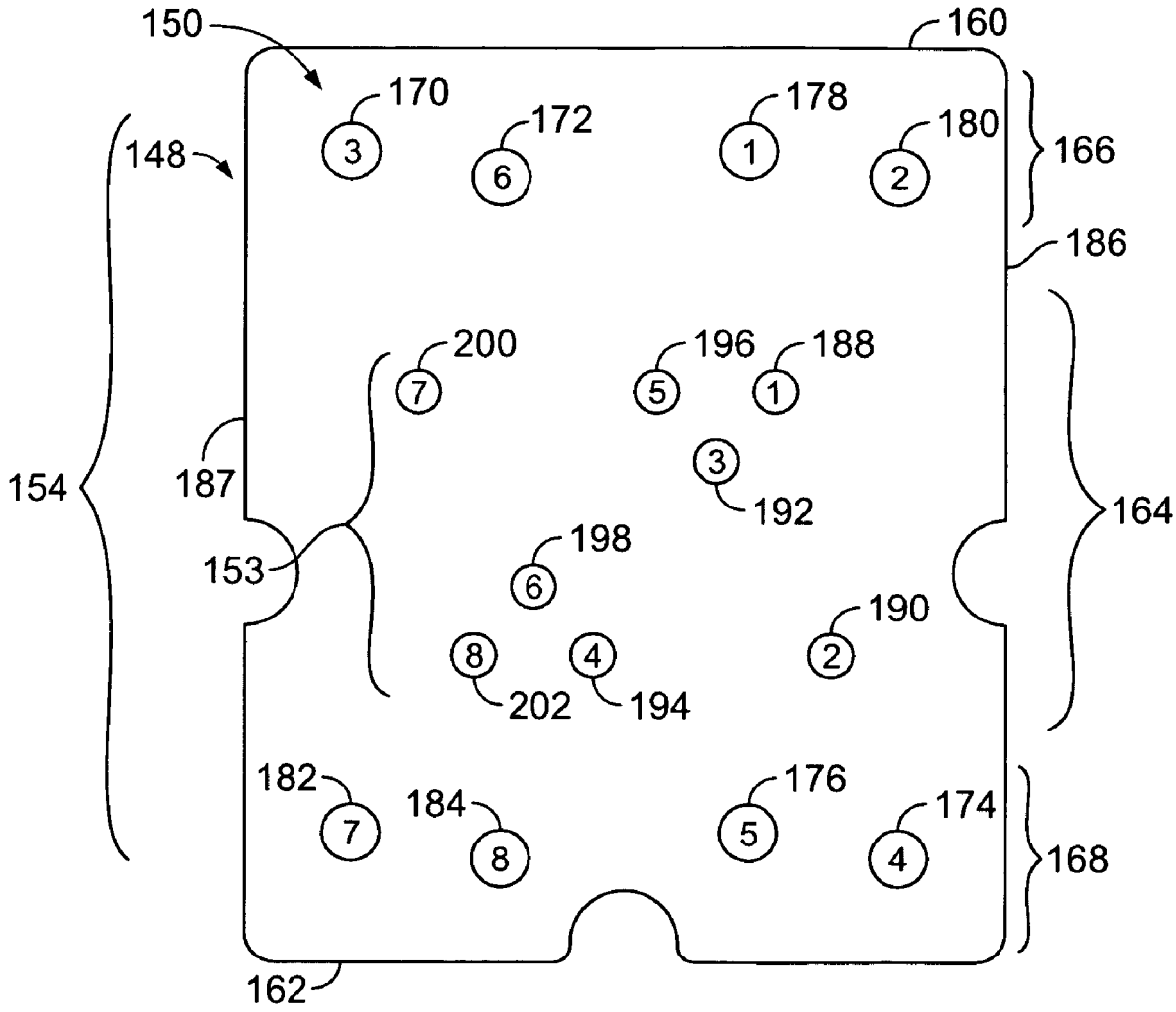
FIG. 4 illustrates a front face of the circuit board of FIG. 2 in accordance with an embodiment of the present invention.

The contact array 106 includes array contacts 124, 126, 128, 130, 132, 134, 136 and 138 that are arranged parallel to one another and oriented to extend from within the parallel notches 123 proximate the lead edge 103 to the rear edge 105 of the base 122. Eight contacts are illustrated in the contact array 106; however, more or less than eight contacts may be used. Array contacts 124 and 126 form a first differential pair 140, array contacts 128 and 134 form a second differential pair 142, array contacts 130 and 132 form a third differential pair 144, and array contacts 136 and 138 form a fourth differential pair 146. Array contacts 124 and 126, 130 and 132, and 136 and 138 of the first, third and fourth differential pairs 140, 144 and 146, respectively, are located immediately adjacent one another. The array contacts 128 and 134 of the second differential pair 142, however, are not located immediately adjacent one another. Instead, the array contacts 128 and 134 of the second differential pair 142 are split or separated from one another by intervening third differential pair 144. The array contact 128 is adjacent to the array contacts 126 and 130 of the first and third differential pairs 140 and 144, respectively, while the array-contact 134 is adjacent to the array contacts 132 and 136 of each of the third and fourth differential pairs 144 and 146. The array contacts 124, 126, 128, 130, 132, 134, 136 and 138 extend along the base 122 in a co-planar arrangement and have contact tails 216 (FIG. 5) that enter the circuit board 148 to define a contact entry pattern 153 (FIG. 4). The contact tails 216 may be soldered to holes in the circuit board 148 or interconnect with the holes using a compliant pin design or other interconnection known in the art.

It should be understood that the circuit board 148, base 122, and the receptacle assembly 100 may vary in size, depending on customer specifications. For example, it may be desirable to make the receptacle assembly 100 as small or compact as possible. Also, further enhancements may be added to the circuit board 148 to modify the transmitted signals.

FIG. 4 illustrates a front face 150 of the circuit board 148 of FIG. 2. The circuit board 148 has a top end 160 and a bottom end 162. Contact holes 188, 190, 192, 194, 196, 198, 200 and 202 form the contact entry pattern 153, which is associated with a particular array layout. The contact entry pattern 153 is illustrated in a central portion 164 of the circuit board 148, but may also be located in an off-center location, such as by shifting the contact entry pattern 153 upward, downward, left or right. The contact holes 188, 190, 192, 194, 196, 198, 200 and 202 accept the contact tails 216 of the array contacts 124, 126, 128, 130, 132, 134, 136 and 138, respectively. Wire termination contact holes 170, 172, 174, 176, 178, 180, 182, and 184 form a wire termination contact pattern 154 located in top and bottom portions 166 and 168 of the circuit board 148 for accepting the wire termination contacts 113.

The contact array 106 enters the circuit board 148 in the contact entry pattern 153 to optimize signal integrity, such as by minimizing noise due to crosstalk, while providing for the configuration of the contact array 106. As illustrated in FIG. 3, the array contacts 124 and 126 and array contacts 136 and 138 cross over each other. Therefore, the array contact 126 enters the circuit board 148 closest to first side 186, and the array contact 136 enters the circuit board 148 closest to the second side 187.

Traces (not shown) electrically connect each of the contact holes 188, 190, 192, 194, 196, 198, 200 and 202 within the central portion 164 with a corresponding one of the wire termination contact holes 170, 172, 174, 176, 178, 180, 182, and 184 in either the top or bottom portion 166 or 168. Each of the holes has been provided with a number (corresponding to a contact or pin) within FIG. 4 to illustrate one exemplary interconnection pattern. The contact hole 188 is electrically joined to wire termination contact hole 178, while contact hole 190 is electrically joined to wire termination contact hole 180. Contact holes 192, 194, 196, 198, 200 and 202 are electrically joined to wire termination contact holes 170, 174, 176, 172, 182 and 184, respectively. Other interconnection patterns may be used.

Figure 5:
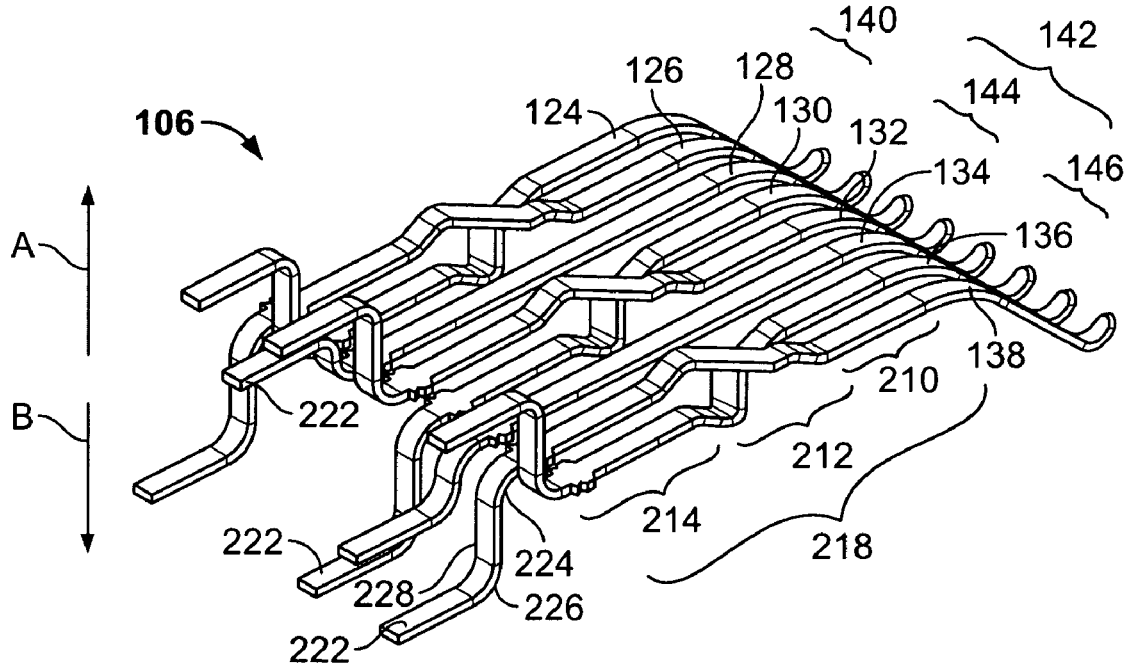
FIG. 5 illustrates a rear perspective view of a contact array formed in accordance with an embodiment of the present invention.

FIG. 5 illustrates a view of the contact array 106 in accordance with an embodiment of the present invention. Like item numbers have been used. First, second and third sections 210, 212 and 214 together form a main section 218 which is held generally perpendicular to the circuit board 148. In a first section 210, the array contacts 124, 126, 128, 130, 132, 134, 136 and 138 extend planar to the base 122 (FIG. 3) and normal to the circuit board 148. In a second section 212, the pairs of array contacts 124 and 126, 130 and 132, and 136 and 138 cross over each other, while the array contacts 128 and 134 continue planar to the base 122. The cross-over pattern compensates for a portion of the crosstalk generated in the plug. In a third section 214, the array contacts 124, 126, 128, 130, 132, 134, 136 and 138 extend planar to the base 122.

Each of the array contacts 124, 126, 128, 130, 132, 134, 136 and 138 has a contact tail 216. Each contact tail 216 is bent to form a first bend 224 of approximately 90 degrees, wherein the array contacts 124, 128, 132 and 136 are bent in an upward direction as indicated by arrow A and the array contacts 126, 130, 134 and 138 are bent in a downward direction as indicated by arrow B. A first tail sub-section 228 extends upwards or downwards, parallel to the circuit board 148 for one of two distances, and then a second bend 226 of approximately 90 degrees is formed. A second tail sub-section 222 extends perpendicular to the circuit board 148 and through one of the contact holes 188, 190, 192, 194, 196, 198, 200 and 202 in the circuit board 148, forming the contact entry pattern 153 (FIG. 4), which is discussed further below.

Figure 6:
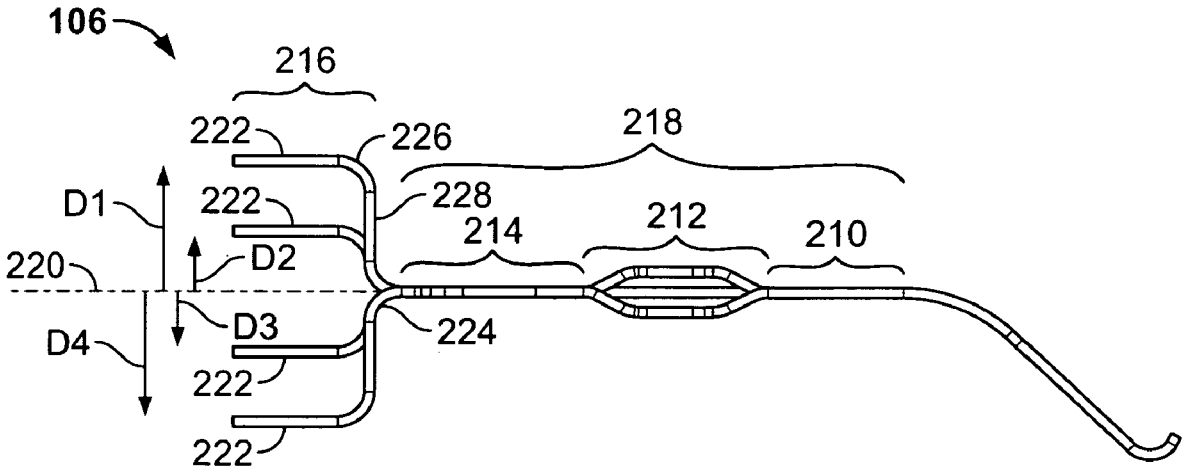
FIG. 6 illustrates a side view of the contact array of FIG. 5 formed in accordance with an embodiment of the present invention.

FIG. 6 illustrates a side view of the contact array 106 in accordance with an embodiment of the present invention. First, second, and third sections 210, 212, and 214 and contact tails 216 are illustrated with like item numbers. Plane 220 illustrates a plane substantially parallel to the plane of the main section 218, which is perpendicular to the circuit board 148. The second tail sub-sections 222 extend in four parallel rows formed at distances D1, D2, D3 and D4 from the plane 220. Distances D1 and D4 are larger than distances D2 and D3. Also, distances D1 and D4 are equal to each other and distances D2 and D3 are equal to each other.

Figure 7:
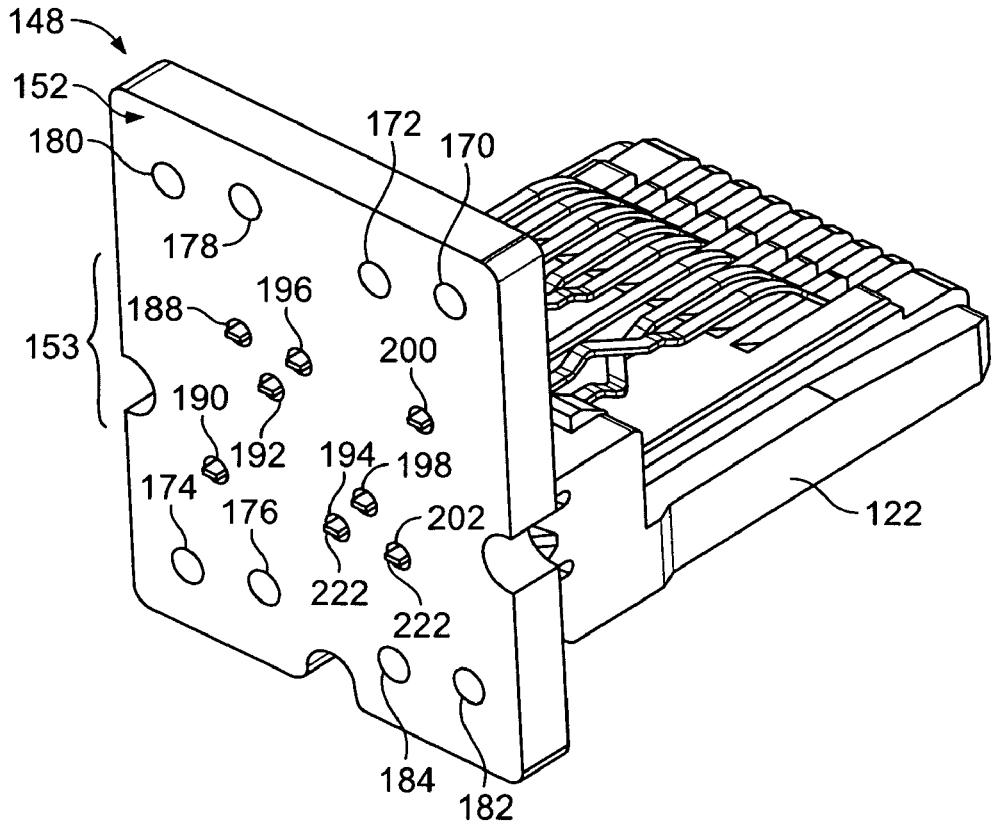
FIG. 7 illustrates a rear perspective view of the sub-assembly of FIG. 2 in accordance with an embodiment of the present invention.

FIG. 7 illustrates a rear perspective view of the sub-assembly 120 of FIG. 3 to better show the contact entry pattern 153 of the second tail sub-sections 222. A rear face 152 of the circuit board 148 is shown. The second tail sub-sections 222 enter the contact holes 188, 190, 192, 194, 196, 198, 200 and 202 in the front face 150 and may extend through and beyond the rear face 152 of the circuit board 148. The second tail sub-sections 222 may be soldered to the circuit board 148, or may be compliant pin, eye of the needle, or other type of connection known in the art.

The spatial relationship of the contact holes 188, 190, 192, 194, 196, 198, 200 and 202 with respect to one another and the spatial relationship of the wire termination contact holes 170, 172, 174, 176, 178, 180, 182, and 184 with respect to one another is determined to achieve a desired electrical performance. For example, the contact holes 188, 190, 192, 194, 196, 198, 200 and 202 and wire termination contact holes 170, 172, 174, 176, 178, 180, 182, and 184 may form patterns for coupling and isolating certain contacts.

The wire termination contact pattern 154 will be discussed first, while the contact entry pattern 153 will be discussed further below. In the cable connected to the wire termination contacts 113 of the wire connector housing 112, the two wires of each wire pair are twisted together. In an RJ-45 application, the wires are paired as wire pairs 1/2, 3/6, 4/5 and 7/8, which are associated with the first, second, third and fourth differential pairs 140, 142, 144 and 146, respectively. Each wire pair is received by wire termination contact holes located proximate different corners of the board 148. Specifically, wire pair 1/2 is received by wire termination contact holes 178 and 180 proximate a first corner, wire pair 3/6 is received by wire termination contact holes 170 and 172 proximate a second corner, wire pair 7/8 is received by wire termination contact holes 182 and 184 proximate a third corner, and wire pair 4/5 is received by wire termination contact holes 174 and 176 proximate a fourth corner.

The wire termination contact holes 170, 172, 174, 176, 178, 180, 182, and 184 are arranged, in part, to avoid creating additional noise in the receptacle assembly 100. As industry standards dictate, the plug contains sizable noise with the most noise occurring between the differential pairs 142 and 144. Because this pair combination has the most noise, the wire termination contact pattern 154 isolates the wire pairs 3/6 and 4/5 from one another. Referring to FIG. 4, wire termination contact holes 170 and 172 accept wire termination contacts 113 interconnected with wire pair 3/6, and wire termination contact holes 174 and 176 accept wire termination contacts 113 interconnected with wire pair 4/5. Wire termination contact holes 170 and 172 are positioned in one corner of the top portion 166 while the wire termination contact holes 174 and 176 are positioned in the opposite corner, respectively, of the bottom portion 168, isolating the second and third differential pairs from one another. In other words, the second and third differential pairs are located far apart from one another on the circuit board 148.

The wire termination contact pattern 154 also takes into consideration the ease of connecting the cable to the receptacle assembly 100. Two color schemes determined by industry standards for the RJ-45 are called 568A and 568B and match pin numbers to wire colors of a cable. Two sets of wire pairs are typically designated specific colors, and therefore, within the cable, wire pair 4/5 is blue, and wire pair 7/8 is brown. For pattern 568A, wire pair 1/2 is green, and wire pair 3/6 is orange. Alternatively, for pattern 568B, wire pair 1/2 is orange and wire pair 3/6 is green. Another consideration relates to the orientation of the wires within the cable jacket. Although not required by the industry, a common wire color breakout is blue-orange-green-brown that rotates either in the clockwise (CW) or counter-clockwise (CCW) direction depending upon which end of the cable is being viewed. Therefore, there are four main patterns that may be presented: A-pattern and CCW, A-pattern and CW, B-pattern and CCW and B-pattern and CW. The wire termination contact pattern 154 was chosen so that one of these four main patterns matches directly to the jack without the need for altering or crossing over the wire pairs within the natural orientation of the cable resulting in ease of installation where possible. The pattern chosen for this embodiment was B-pattern and CCW.

While corresponding to the industry, the wire termination contact pattern 154 further improves performance by separating noisy pairs. The wire pair 4/5 is blue and corresponds to the wire termination contact holes 174 and 176, and the wire pair 3/6 corresponds to the wire termination contact holes 170 and 172, which are located in an opposite corner of the board 148 with respect to the wire termination contact holes 174 and 176. The wire pair 3/6 may be either green or orange. Therefore, in one embodiment, the wire pair 1/2 is orange and corresponds to wire termination contact holes 178 and 180, while the wire pair 3/6 is green and corresponds to wire termination contact holes 170 and 172. In another embodiment, the wire pair 1/2 may be green while the wire pair 3/6 may be orange.

The contact entry pattern 153 will now be discussed. As stated previously, in an RJ-45 plug, one of the four differential pairs is split around another. Industry standards require a split pair and also dictate how much noise needs to occur in the plug. The highest degree of crosstalk is created between these two pairs, but the other pair combinations also exhibit crosstalk that is not insignificant. This is partly due to the large parallel blades in the plug, and sometimes, the parallel nature of the wires as they are dressed into the plug. Therefore, it is desirable to counteract this noise in the receptacle assembly 100, such as through compensation in the receptacle assembly 100, so the mated connector (the plug and the receptacle assembly 100 joined together) has a significantly smaller amount of noise than the plug alone.

Figure 8:
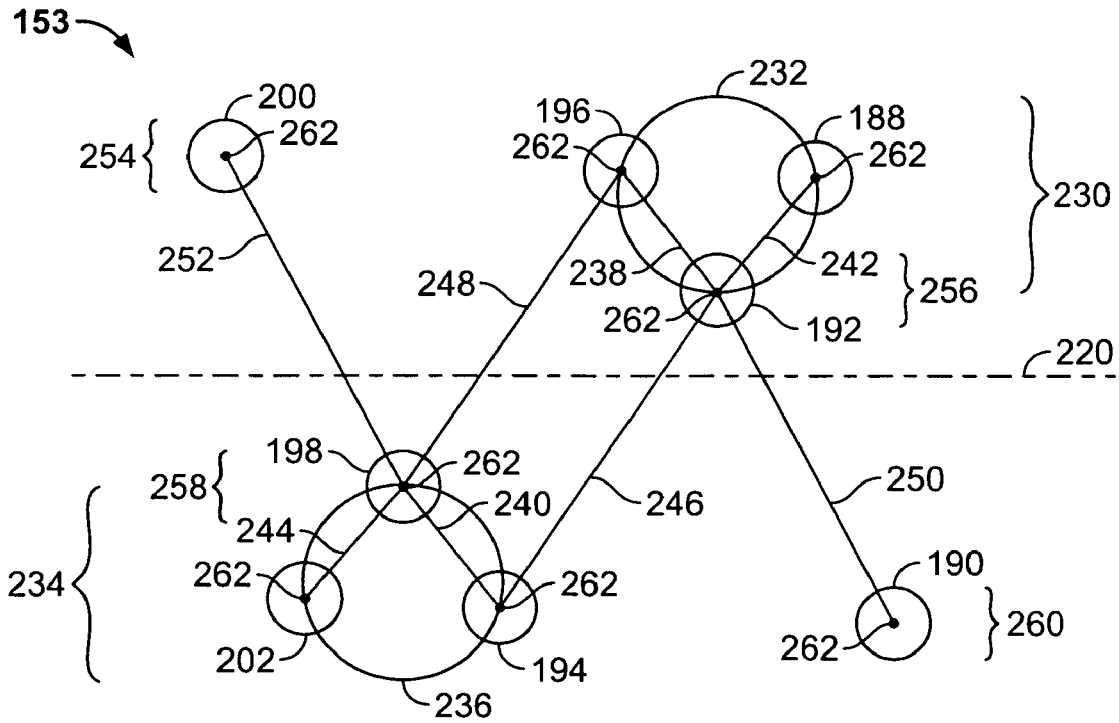
FIG. 8 illustrates a contact entry pattern in accordance with an embodiment of the present invention.

FIG. 8 illustrates relationships between and groupings of the contact holes 188, 190, 192, 194, 196, 198, 200 and 202 within the contact entry pattern 153. Each of the contact holes 188, 190, 192, 194, 196, 198, 200 and 202 has a center 262. Circles and lines are used to show relationships and/or distances between the centers 262 of the contact holes 188, 190, 192, 194, 196, 198, 200 and 202, and therefore the circles and lines themselves do not form a part of the contact entry pattern 153.

A first group 230 includes the contact holes 188, 192 and 196 arranged in a triangular layout. A circle 232, which may have a minimum diameter of 0.04 inch, captures the center 262 of each of the contact holes 188, 192 and 196. In one embodiment, the circle 232 may have a diameter of 0.082 inch. Optionally, the circle 232 may have a diameter of up to 0.140 inch. A second group 234 includes the contact holes 194, 198 and 202 which are also arranged in a triangular layout. A circle 236 captures the center 262 of each of the contact holes 194, 198 and 202 and may also have a diameter from 0.04 inch to 0.140 inch.

The contact entry pattern 153 may be further described by referring again to FIG. 6. The plane 220 has been indicated on FIG. 8. A first subset 254 includes the contact holes 200, 196 and 188, and the center 262 of each is the distance D1 from the plane 220. A second subset 256 includes contact hole 192, the center 262 of which is the distance D2 from the plane 220. Third subset 258 includes contact hole 198, the center 262 of which is the distance D3 from the plane 220. Fourth subset 260 includes contact holes 202, 194 and 190, and the center 262 of each is the distance D4 from the plane 220. As stated previously, the distances D1 and D4 are equal to each other and distances D2 and D3 are equal to each other.

As discussed previously, the eight parallel blades in the plug experience crosstalk. Regarding second differential pair (blades 3/6) and third differential pair (blades 4/5), blades 3 and 4 and blades 5 and 6 have the greatest level of noise due to their close proximity with each other. Correspondingly, in the receptacle assembly 100, the array contacts' 128 and 130 and the array contacts 132 and 134 experience a higher level of noise due to their close proximity to one another. It is desired to isolate the sets of contacts experiencing the higher level of noise. Thus, the array contacts 128 and 130 are received by the contact holes 192 and 194, respectively, which are located away from each other, and the array contacts 132 and 134 are received by contact holes 196 and 198, respectively, which are located away from each other. In FIG. 8, line 246 extends between the centers 262 of the contact holes 192 and 194 and line 248 extends between the centers 262 of the contact holes 196 and 198, illustrating a distance between the centers 262 of the respective contact holes, which may be from 0.120 inch to 0.20 inch. In one embodiment, the distance may be 0.160 inch.

The noise in the receptacle assembly 100 may be further counteracted through compensation by placing other array contacts close to one another. The array contacts 128 and 132 are received by contact holes 192 and 196, respectively, which are located in close proximity to each other, and the array contacts 130 and 134 are received by contact holes 194 and 198, respectively, which are located in close proximity to each other. In FIG. 8, line 238 extends between the centers 262 of the contact holes 192 and 196 and line 240 extends between the centers 262 of the contact holes 194 and 198, illustrating a distance between the centers 262 of the respective contact holes which may be from 0.02 inch to 0.100 inch. In one embodiment, the distance may be 0.064 inch.

Three of the differential pairs experience a secondary level of noise, or second tier of crosstalk, in the plug. The second differential pair (blades 3/6) experiences a high level of noise with both the first differential pair (blades 1/2) and fourth differential pair (blades 7/8) due to their proximity in the plug and because the second differential pair is a split pair.

To isolate signals experiencing a high level of noise, the array contacts 126 and 128 are received by contact holes 190 and 192, respectively, which are located away from each other, and array contacts 134 and 136 are received by contact holes 198 and 200, respectively, which are located away from each other. In FIG. 8, line 250 extends between the centers 262 of the contact holes 190 and 192 and line 252 extends between the centers 262 of the contact holes 198 and 200, illustrating a distance between the centers 262 of the respective contact holes, which may be from 0.120 inch to 0.20 inch. Similarly, to couple signals to counteract the crosstalk occurring in the RJ-45 plug, contact holes 188 and 192 receiving array contacts 124 and 128, respectively, and contact holes 198 and 202 receiving array contacts 134 and 138, respectively, are placed in closer proximity to one another on the circuit board 148. In FIG. 8, line 242 extends between the centers 262 of the contact holes 188 and 192 and line 244 extends between the centers 262 of the contact holes 198 and 202, illustrating a distance between the centers 262 of the respective contact holes, which may be from 0.02 inch to 0.100 inch.

Return loss which occurs throughout the jack and the receptacle assembly 100 is also considered. A signal sent down two pins (or contacts or wires) in a differential pair has an impedance based on at least one of cross-section of the conductor, space between the conductors and the dielectric constant separating the two conductors in a pair. The adjacent array contacts of the first, third and fourth differential pairs 140, 144 and 146 have essentially the same geometry, and are close together in the receptacle assembly 100, resulting in an impedance between the array contacts of each pair that is lower than desired. By increasing the impedance to match the target impedance, such as 100 ohms, the return loss is improved. Therefore, contact holes 200 and 202 receiving array contacts 136 and 138, respectively, of the fourth differential pair, are placed farther apart with respect to each other, as are contact holes 188 and 190 receiving array contacts 124 and 126, respectively, of the first differential pair, and contact holes 194 and 196 receiving array contacts 130 and 132, respectively, of the third differential pair. Distance between the contact holes of a differential pair may be increased to increase the impedance, providing a more favorable return loss.

While the invention has been described in terms of various specific embodiments, those skilled in the art will recognize that the invention can be practiced with modification within the spirit and scope of the claims.

What is claimed is:

1. A receptacle assembly comprising:

a housing having front and rear ends, the front end being configured to receive a plug, the rear end being configured to accept wire termination contacts;

a circuit board comprising a plurality of contact holes, the circuit board held within the housing; and a plurality of array contacts arranged in a contact array within the housing, wherein each of the plurality of array contacts comprises a main section and a contact tail, wherein the main section of the each of the plurality of array contacts runs generally perpendicular to the circuit board, wherein the contact tail of the each of the plurality of array contacts has a first bend to form a first tail sub-section extending parallel to the circuit board and a second bend to form a second tail sub-section extending perpendicular to the circuit board, and wherein the second tail sub-section of the each of the plurality of array contacts is received by one of the plurality of contact holes in the circuit board, wherein the plurality of array contacts further comprises first and second subsets of array contacts and the first tail sub-sections of the first and second subsets of array contacts extend the same distance in opposite directions, wherein the plurality of array contacts further comprises a third subset of array contacts and the first tail sub-sections of the first and third subsets of array contacts extend first and third distances, respectively, in the same direction from the first bend, the first and third distances being different with respect to each other.

2. The receptacle assembly of claim 1, further comprising:

the contact array further comprising first and second array contacts forming a first differential pair and third and sixth array contacts forming a second differential pair and fourth and fifth array contacts forming a third differential pair and seventh and eighth array contacts forming a fourth differential pair; and the circuit board further comprising wire termination contact holes for receiving the wire termination contacts, wherein the wire termination contact holes configured to receive the wire termination contacts associated with the second differential pair are located proximate a top end and a second side of the circuit board and the wire termination contact holes configured to receive the wire termination contacts associated with the third differential pair are located proximate a bottom end and a first side of the circuit board, the plurality of contact holes being located in a central portion of the circuit board.

3. The receptacle assembly of claim 1, wherein the plurality of array contacts further comprises a fourth subset of array contacts, wherein the first bends of the first and third subsets and the first bends of the second and fourth subsets of array contacts are formed to extend the first tail sub-sections in first and second directions, respectively, the first and second directions being opposite one another and parallel to the circuit board.

4. The receptacle assembly of claim 1, wherein the plurality of array contacts further comprises a fourth subset of array contacts, wherein the first tail sub-sections of the first and third subsets of array contacts extend for distances D1 and D3, respectively, in a first direction and wherein the first tail sub-sections of the second and fourth subsets of array contacts extend for distances D2 and D4, respectively, in a second direction, the first and second directions being opposite each other, wherein the distances D1 and D4 are the same and the distances D2 and D3 are the same.

5. The receptacle assembly of claim 1, further comprising:

the contact array further comprising fourth and fifth array contacts forming a third differential pair and third and sixth array contacts forming a second differential pair, wherein the fourth and fifth array contacts are located adjacent each other, and wherein the third and sixth array contacts are located on either side of the fourth and fifth array contacts within the main section of the contact array;

each of the plurality of contact holes further comprising a center; and the plurality of contact holes further comprising third, fourth, fifth and sixth contact holes for receiving the third, fourth, fifth and sixth array contacts, respectively, wherein the centers of the third and fourth contact holes are separated by at least 0.120 inch and wherein the centers of the fifth and sixth contact holes are separated by at least 0.120 inch.

6. The receptacle assembly of claim 1, further comprising:

the contact array further comprising fourth and fifth array contacts forming a third differential pair and third and sixth array contacts forming a second differential pair, wherein the fourth and fifth array contacts are located adjacent each other, and wherein the third and sixth array contacts are located on either side of the fourth and fifth array contacts within the main section of the contact array;

each of the plurality of contact holes further comprising a center; and the plurality of contact holes further comprising third, fourth, fifth and sixth contact holes for receiving the third, fourth, fifth and sixth array contacts, respectively, wherein the centers of the third and fifth contact holes are separated by a distance of 0.02 inch to 0.100 inch, and wherein the centers of the fourth and sixth contact holes are separated by a distance of 0.02 inch to 0.100 inch.

7. The receptacle assembly of claim 1, further comprising:

the contact array further comprising first, second, third, fourth, fifth, sixth, seventh and eighth array contacts, wherein the first and second array contacts form a first differential pair, wherein the third and sixth array contacts form a second differential pair, wherein the fourth and fifth array contacts form a third differential pair, and wherein the seventh and eighth array contacts form a fourth differential pair, wherein the first and second array contacts are located adjacent to each other, wherein the third and sixth array contacts are located on either side of the fourth and fifth array contacts within the main section of the contact array, wherein the first and second array contacts are located adjacent to each other and the third array contact, and wherein the seventh and eighth array contacts are located adjacent to each other and the sixth array contact;

each of the plurality of contact holes further comprising a center; and the plurality of contact holes further comprising first, second, third, fourth, fifth, sixth, seventh, and eighth contact holes for receiving the first, second, third, fourth, fifth, sixth, seventh, and eighth array contacts, respectively, wherein the first, third and fifth contact holes form a first group arranged in a triangular layout and wherein the fourth, sixth and eighth contact holes form a second group arranged in a triangular layout, wherein the first and third and third and fifth contact holes are located a distance of 0.02 inch to 0.100 inch apart, and wherein the fourth and sixth and sixth and eighth contact holes are located a distance of 0.020 inch to 0.100 inch apart.

8. The receptacle assembly of claim 1, the contact holes being located in a central portion of the circuit board.

9. The receptacle assembly of claim 1, further comprising:

the contact array further comprising first, second, third, fourth, fifth, sixth, seventh and eighth array contacts, wherein the first and second array contacts form a first differential pair, wherein the third and sixth array contacts form a second differential pair, wherein the fourth and fifth array contacts form a third differential pair, and wherein the seventh and eighth array contacts form a fourth differential pair, wherein the first and second array contacts are located adjacent to each other, wherein the third and sixth array contacts are located on either side of the fourth and fifth array contacts within the main section of the contact array, wherein the first and second array contacts are located adjacent to each other and the third array contact, and wherein the seventh and eighth array contacts are located adjacent to each other and the sixth array contact;

each of the plurality of contact holes further comprising a center; and the plurality of contact holes further comprising second, third, sixth, and seventh contact holes for receiving the second, third, sixth, and seventh array contacts, respectively, wherein the centers of the second and third contact holes are separated by at least 0.120 inch and wherein the centers of the sixth and seventh contact holes are separated by at least 0.120 inch.

10. The receptacle assembly of claim 1, further comprising:

the contact array further comprising first, second, third, fourth, fifth, sixth, seventh and eighth array contacts, wherein the first and second array contacts form a first differential pair, wherein the third and sixth array contacts form a second differential pair, wherein the fourth and fifth array contacts form a third differential pair, and wherein the seventh and eighth array contacts form a fourth differential pair, wherein the first and second array contacts are located adjacent to each other, wherein the third and sixth array contacts are located on either side of the fourth and fifth array contacts within the main section of the contact array, wherein the first and second array contacts are located adjacent to each other and the third array contact, and wherein the seventh and eighth array contacts are located adjacent to each other and the sixth array contact;

each of the plurality of contact holes further comprising a center; and the plurality of contact holes further comprising first, third, sixth and eighth contact holes for receiving the first, third, sixth and eighth array contacts, respectively, wherein the centers of the first and third contact holes are separated by a distance of 0.02 inch to 0.100 inch, and wherein the centers of the sixth and eighth contact holes are separated by a distance of 0.02 inch to 0.100 inch.

11. A receptacle assembly comprising:

a housing having front and rear ends, the front end being configured to receive a plug, the rear end being configured to accept wire termination contacts;

a plurality of array contacts arranged in a contact array within the housing, the contact array comprising first, second, third, and fourth differential pairs, wherein first and second array contacts form the first differential pair, wherein third and sixth array contacts form the second differential pair, wherein fourth and fifth array contacts form the third differential pair and wherein seventh and eighth array contacts form the fourth differential pair, wherein the fourth and fifth array contacts are located adjacent to each other, wherein the third and sixth array contacts are located on either side of the fourth and fifth array contacts, wherein the first and second array contacts are located adjacent to each other and the third array contact, and wherein the seventh and eighth array contacts are located adjacent to each other and the sixth array contact; and a circuit board comprising a plurality of contact holes arranged in a contact array pattern, the circuit board being held within the housing, the plurality of contact holes comprising first, second, third, fourth, fifth, sixth, seventh, and eighth contact holes for receiving the first, second, third, fourth, fifth, sixth, seventh, and eighth array contacts, respectively, wherein the first, third and fifth contact holes are arranged in a first group having a triangular layout and wherein the fourth, sixth and eighth contact holes are arranged in a second group haying a triangular layout, wherein the third contact hole of the first group is separated from the fourth contact hole of the second group by a distance that is greater than a distance between the third contact hole and the fifth contact hole of the first group.

12. The receptacle assembly of claim 11, wherein the circuit board further comprises a plurality of wire termination contact holes arranged in a wire termination contact pattern, wherein the circuit board has a top end and a bottom end located opposite one another and wherein the circuit board has a first side and a second side located opposite one another, the wire termination contacts comprising first, second, third, and fourth pairs associated with the first, and fourth differential pairs, respectively, wherein the first pair of the wire termination contact holes are located proximate the top end and the first side of the circuit board, wherein the second pair of the wire termination contact holes are located proximate the top end and the second side of the circuit board, wherein the third pair of the wire termination contact holes are located proximate the bottom end and the first side of the circuit board, and wherein the fourth pair of the wire termination contact holes are located proximate the bottom end and the second side of the circuit board.

13. The receptacle assembly of claim 11, wherein each of the plurality of contact holes comprises a center, wherein the seventh contact hole is located in a line with the first and fifth contact holes and the second contact hole is located in a line with the fourth and eighth contact holes, wherein the second and seventh contact holes are located proximate to the first and second sides of the circuit board, respectively, and wherein the centers of the second and third contact holes and the centers of the sixth and seventh contact holes are located a distance of 0.120 inch to 0.20 inch apart.

14. The receptacle assembly of claim 11, wherein the sixth contact hole of the second group is separated from the fifth contact hole of the first group by a distance that is greater than a distance between the sixth contact hole and the fourth contact hole of the second group.

15. The receptacle assembly of claim 11, wherein each of the plurality of array contacts comprises a main section, wherein the main section of each of the plurality of array contacts intersects a common plane that extends generally perpendicular to the circuit board, the first group of the contact holes being offset from the plane in a first direction, the second group of the contact holes being offset from the plane in a second direction that is opposite the first direction.

16. The receptacle assembly of claim 11, wherein the first group of the contact holes is separated from the second group of the contact holes by a greater distance than the spacing between each of the contact holes of the first group and the spacing between each of the contact holes of the second group.

17. The receptacle assembly of claim 11, wherein each of the plurality of contact holes comprises a center, the center of the third contact hole of the first group and the center of the fourth contact hole of the second group being located a minimum distance of 0.120 inches to a maximum distance of 0.20 inches apart, the center of the fifth contact hole of the first group and the center of the sixth contact hole of the second group being located a minimum distance of 0.120 inches to a maximum distance of 0.20 inches apart.

18. The receptacle assembly of claim 11, wherein each of the plurality of contact holes further comprises a center wherein the centers of the first and third and third and fifth contact holes are located from a minimum distance of 0.02 inch to a maximum distance of 0.100 inch apart, and wherein the centers of the fourth, sixth and eighth contact holes are located a minimum distance of 0.02 inch to a maximum distance of 0.100 inch apart.

19. The receptacle assembly of claim 11, wherein each of the plurality of contact holes further comprises a center, wherein the first, third and fifth contact holes are arranged whereby a first circle having a diameter of 0.04 inch to 0.140 inch intersects the centers of the first, third and fifth contact holes, and wherein the fourth, sixth and eighth contact holes are arranged whereby a second circle having a diameter of 0.04 inch to 0.140 inch intersects the centers of the fourth, sixth and eighth contact holes.

20. The receptacle assembly of claim 11, wherein the second and third contact holes are located approximately the same distance from each other as the third and fourth contact holes, and wherein the sixth and seventh contact holes are located approximately the same distance from each other as the fifth and sixth contact holes.

21. The receptacle assembly of claim 11, wherein each of the plurality of contact holes further comprises a center, and wherein the second and third, third and fourth, fifth and sixth, and sixth and seventh contact holes are located a minimum distance of 0.120 inch to a maximum distance of 0.20 inch apart.

22. A receptacle assembly comprising:

a housing having front and rear ends, the front end being configured to receive a plug, the rear end being configured to accept wire termination contacts;

a plurality of array contacts arranged in a contact array within the housing, each of the plurality of array contacts comprising a main section that intersects a common plane, the contact array comprising second and third differential pairs, wherein third and sixth array contacts form the second differential pair, and wherein fourth and fifth array contacts form the third differential pair, the fourth and fifth array contacts being located adjacent to each other, the third and sixth array contacts being located on either side of the fourth and fifth array contacts along the main sections thereof; and a circuit board comprising a plurality of contact holes arranged in a contact array pattern, the circuit board being held within the housing, the plurality of contact holes comprising third, fourth, fifth, and sixth contact holes for receiving the third, fourth, fifth, and sixth array contacts, respectively, wherein the third and fifth contact holes are arranged in a first group and wherein the fourth and sixth contact holes are arranged in a second group, the plane intersected by the main sections of the array contacts extending generally perpendicular to the circuit board, the first group of the contact holes being offset from the plane in a first direction, the second group of the contact holes being offset from the plane in a second direction that is opposite the first direction.

* * * * *